US005344032A

United States Patent [19]

Ramsdell

[11] Patent Number: 5,344,032

[45] Date of Patent: Sep. 6, 1994

[54] GUN HOLDER FOR VEHICLES

[76] Inventor: Wayne W. Ramsdell, Rte. 1, Box 129, Westfield, Iowa 51062

[21] Appl. No.: 157,468

[22] Filed: Nov. 26, 1993

[51] Int. Cl.[5] ..... A47F 7/00

[52] U.S. Cl. ..... 211/64; 211/70.8

[58] Field of Search ..... 211/64, 70.8; 224/913; 248/74.2, 201, 206.3, 206.4, 316.7, 316.8

[56] References Cited

U.S. PATENT DOCUMENTS

| | | | |
|---|---|---|---|
| 2,632,619 | 3/1953 | Wilson | 211/64 X |
| 2,929,539 | 3/1960 | Safreno | 211/64 X |
| 3,167,182 | 1/1965 | Calvin | 211/64 |
| 3,477,587 | 11/1969 | Hart | 211/64 |
| 5,078,279 | 1/1992 | Hancock et al. | 211/64 |

*Primary Examiner*—Alvin C. Chin-Shue
*Assistant Examiner*—Sarah A. Lechok

[57] ABSTRACT

A system of holders for carrying long guns in automobiles. The holders are somewhat malleable and include liner devices for the holder at the barrel end of the gun to hold the barrel tightly. The malleability allows the holder to be shaped to hold the stock end tightly closed.

5 Claims, 2 Drawing Sheets

GUN HOLDER FOR VEHICLES

BACKGROUND AND SUMMARY OF THE INVENTION

This invention pertains to gun racks for the carrying of long guns (rifles and shotguns) in a vehicle such as a car or pickup truck or van. The principal goal of the improved device is to hold the gun firmly so that it will not move while in the holder.

Gun racks for pickups, trucks, utility vans and automobiles are fairly common. Generally, the racks comprise hooks into which a gun may be inserted for carrying. Riding over bumpy roads usually caused the gun to rattle in the rack causing extra undesired noise as well as creating a wearing between the surface of the gun barrel or the gun stock against the rack frequently to the damage of the gun. Especially with decorated gun stocks, that wearing is undesirable.

Using different sizes of racks to accommodate different gun sizes would seem appropriate. However, to carry a double barrelled rifle and a double barrelled side-by-side gun in similar racks requires considerable variation in sizes particularly in the part of the rack holding the barrel. It is obviously preferred to use a single sized rack for all sizes of guns so that it is not necessary to have multiple racks each appropriate for just a narrow range of gun sizes.

The present invention makes possible a single size gun rack available for almost any type of rifle or shotgun in any assortment. The guns will be held tightly in the rack so that there will not be marring or unnecessary wearing of the gun because of rubbing on the rack.

DESCRIPTION

Figure 1:
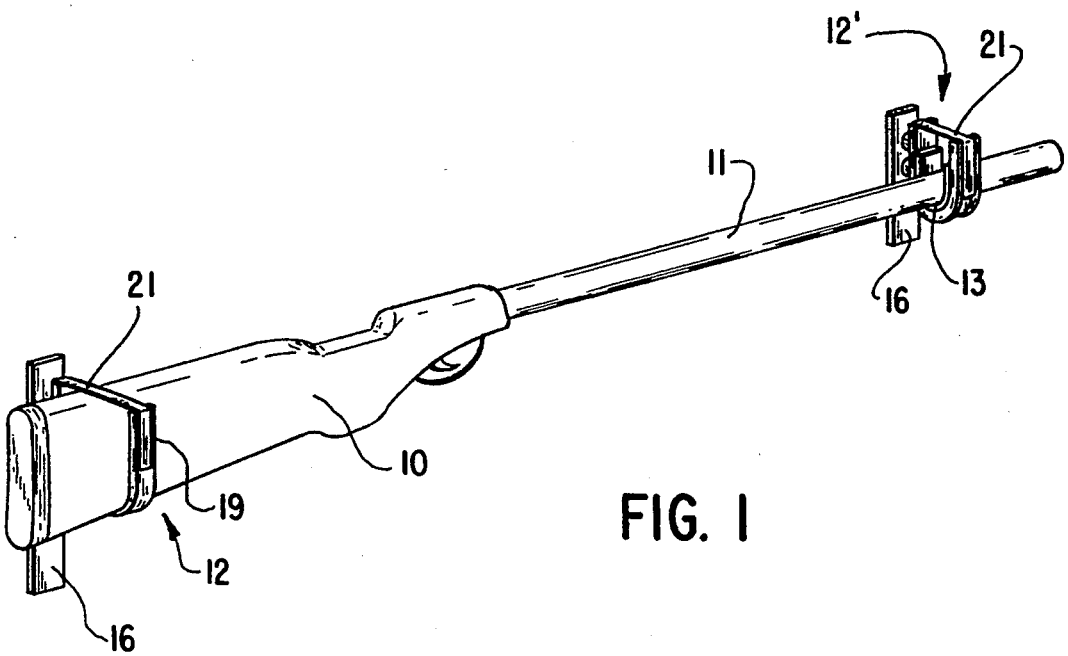
FIG. 1 is perspective view of a gun cradled in the new rack.

Briefly this invention comprises a gun rack having two brackets formed of a malleable material. One end is formed to receive the stock of the gun and the other may have an insert adapted to fit the barrel of the gun.

More specifically and referring to the drawings, the rack is comprised of two brackets, one adapted to hold the stock 10 of a gun and a second to hold the barrel 11. The bracket 12 at the stock end of the gun is substantially the same as the bracket 12' at the barrel end. The difference is only in the insert 13 at the barrel end.

Figure 2:
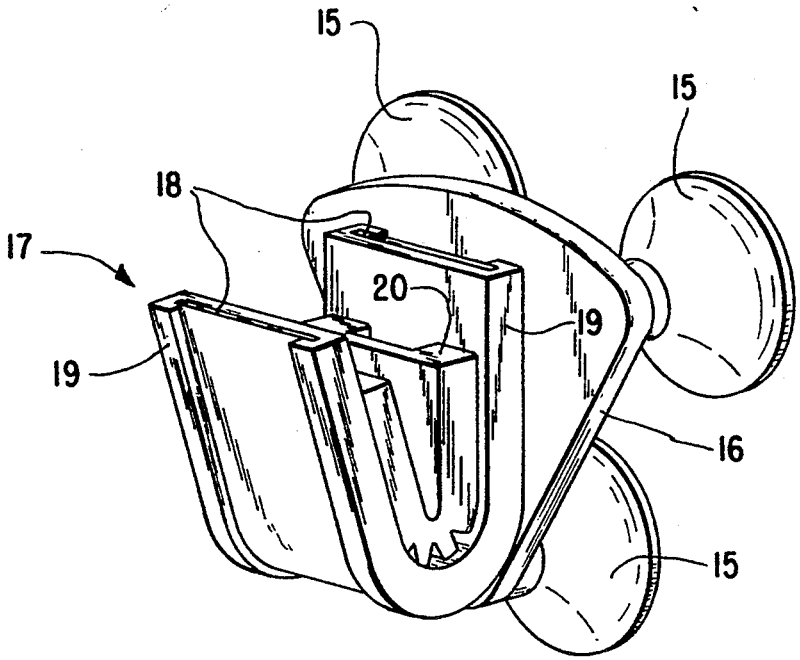
FIG. 2 is a detailed view to an enlarged scale of the barrel end support with the holding strap omitted to show the basic structure.

A more detailed view of a single bracket is shown in FIG. 2. This figure also illustrates that the brackets may be attached to the vehicle in any of several ways. For example, the two brackets shown in FIG. 1 may be attached to a mounting piece to which the brackets are attached, or they may be separately attached to the ceiling of a van or pickup. The device shown in FIG. 2 illustrates that the brackets may be individually attached to a window—usually the rear window of a pickup—by using suction cups 15 which may be cemented to the window.

The bracket itself comprises a mounting plate 16 to which is attached a holding strip 17. This strip is a compound strip having a core 18 composed of a strip of deformable material. The preferred material is an aluminum alloy such as "Duralumin" which is usually stiff enough to hold its shape in the U-form shown, but which can be bent enough to be deformed to match varying sizes of gun stocks. A padded and foamed material such as a foamed rubber is used to create a cover 19 for the edges and the inner surface of the U-shape so that the part of the gun being held will not be damaged by direct contact with the metal of the bracket.

A liner 20 of the same material or of any rubber-like material, which may or may not have the metal core, is inserted in the U-shape. This liner reduces the space between legs of the U-shape so that a gun barrel may be firmly held in the bracket.

A strap 21 (FIG. 1) is fixed at one end to the bracket and may be used to pull the bracket into close-fitting relationship to the part of the gun being held. The other end of the strap may be conveniently attached to the core 18 by the use of a pressure-sensitive, hook fastening material such as "Velcro". Attachment of such material to the second end of the straps and matching material to the U-shape bracket is well within the skill of the ordinary mechanic.

It will be obvious that a pair of brackets 12 and 12' can be mounted in fixed positions in a pickup truck or a van so that the gun stock 10 can be held by one bracket 12 without a liner and the barrel 11 can be held by a liner 20. The straps 21 on both brackets can be pulled tight and because of the flexibility in the core 18 of the brackets, the gun will be firmly and tightly but releasably held in the bracket.

Figure 5:
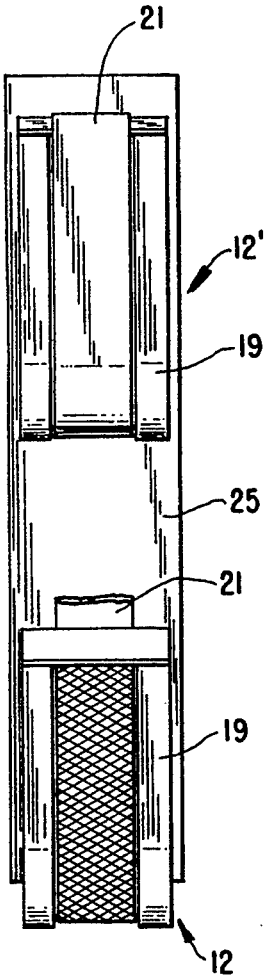
FIG. 5 is a front elevational view of the rack of FIG. 3.
Figure 3:
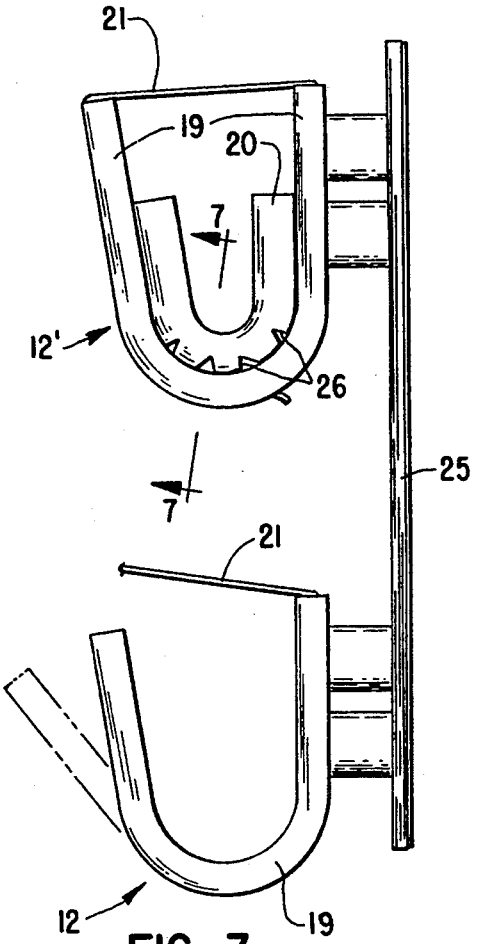
FIG. 3 is an end elevational view of a two-gun rack embodying the invention
Figure 4:
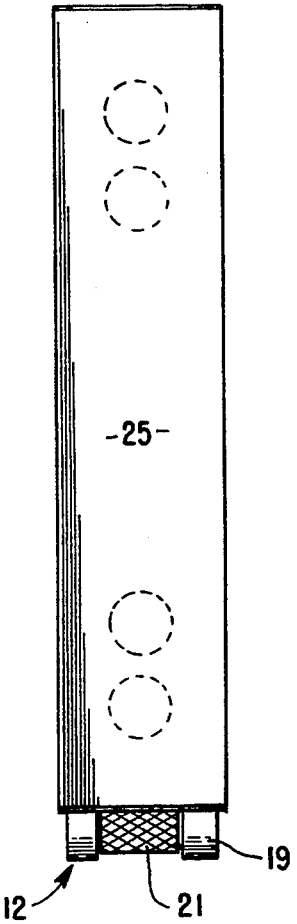
FIG. 4 is a back elevational view of the rack of FIG. 3.

Because gun owners frequently desire to carry more than one gun, it is envisioned, as illustrated in FIGS. 3–5, that the brackets may be mounted in pairs. In this embodiment a single long (usually vertical) mounting plate 25 may be used. A pair of brackets 12 and 12' may be mounted on each plate 25 if the guns are to be carried in alternate positions. If both guns are pointed in the same direction, a pair of brackets 12 may be mounted on one plate 25 and matching brackets 12' may be mounted on a second strip.

Figure 6:
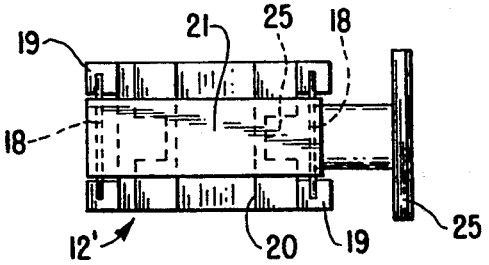
FIG. 6 is a top plan view of the rack of FIG. 3.
Figure 7:
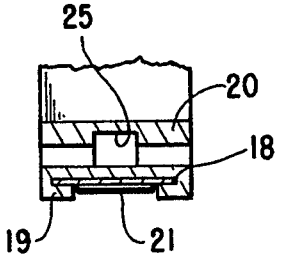
FIG. 7 is a sectional view from line 7–7 of FIG. 3.

In either case, the brackets are similar to those first described, each having a core 18 enclosed in a cover 19 and having a tightening strap 21. The dashed line image in FIG. 3 illustrates how the flexibility of the core allows the bracket 12 to be opened up for the insertion of the gun stock. The U-shape can then be closed around the stock and held in place by the strap 21. The liner 20 is illustrated in these figures in its preferred form of a simple rubber-like piece. In cross section, the preferred form includes a channel 25 (FIGS. 6 and 7) both to lighten the weight and to make the liner more flexible. For the latter purpose (flexibility), there are also lateral groves 26 cut into the liner to allow sharper bending around the barrel of the gun.

Thus, it is apparent that the brackets may be readily mounted for the carrying of a plurality of guns on a single combination rack.

I claim as my invention:

1. A holding device for holding a gun in a gun rack comprising a mounting plate, flexible U-shaped holder means attached to said mounting plate, said U-shape being composed of two legs and a curved part connecting said legs, a separable liner fitted into said U-shape, said liner being thus adapted to hold the barrel of said gun.

2. The holding device of claim 1 in which a strap engages both legs of said U-shaped holder, said strap being adjustable to pull said legs together to tighten the holding of said barrel.

3. The holding device of claim 2 in which a first end of said strap is fixed to a first leg of said U-shape, mating pressure sensitive fastening material being attached to said second end of said strap and to a second leg of said U-shape whereby said strap can be fastened to said second leg in adjustable positions to securely hold the liner against said gun.

4. The holding device of claim 2 in which said liner fits within said curved part of said U-shape, said liner being notched adjacent said curved part to increase the flexibility of said liner.

5. For holding a gun having a gun stock and a barrel, a gun rack comprising two U-shaped brackets, a first bracket being adapted to hold said stock and a second bracket spaced from said first bracket in position to hold said barrel, said brackets both being composed of a bendable metal core and a formed covering material for said core, said second bracket including a removable liner adapted to securely grip said barrel and adjustable strap means on each bracket engaged with the legs of said U-shapes whereby said strap means is effective to pull said U-shapes together to securely grip said stock and said barrel.

* * * * *